US007856111B2

(12) United States Patent
Balke et al.

(10) Patent No.: US 7,856,111 B2
(45) Date of Patent: Dec. 21, 2010

(54) HEARING AID WITH SOUND TUBE SERVING FOR RETENTION IN CONCHA

(75) Inventors: Mark Balke, Nürnberg (DE); Uwe Rass, Nürnberg (DE); Knud Ammitzboll, Berkeley Heights, NJ (US)

(73) Assignee: Siemens Audiologische Technik GmbH, Erlangen (DE)

( * ) Notice: Subject to any disclaimer, the term of this patent is extended or adjusted under 35 U.S.C. 154(b) by 1113 days.

(21) Appl. No.: 11/544,209

(22) Filed: Oct. 4, 2006

(65) Prior Publication Data

US 2008/0095392 A1 Apr. 24, 2008

(51) Int. Cl.
*H04R 25/00* (2006.01)

(52) U.S. Cl. ..... 381/328; 381/322; 381/380

(58) Field of Classification Search ..... 381/23.1, 381/322–324, 328, 380
See application file for complete search history.

(56) References Cited

U.S. PATENT DOCUMENTS

| | | | | |
|---|---|---|---|---|
| 4,069,400 | A | 1/1978 | Johanson et al. | |
| 4,375,016 | A | 2/1983 | Harada | |
| 6,048,305 | A | 4/2000 | Bauman et al. | |
| 2005/0190939 | A1 | 9/2005 | Fretz | |
| 2007/0280496 | A1 * | 12/2007 | Karamuk et al. | 381/328 |
| 2009/0123010 | A1 | 5/2009 | Cano et al. | |
| 2009/0323993 | A1 * | 12/2009 | Slemming et al. | 381/328 |

FOREIGN PATENT DOCUMENTS

| | | |
|---|---|---|
| DE | 83 28 154.1 | 2/1984 |
| DE | 299 16 891 U1 | 2/2000 |
| DE | 10 2005 008 319 B3 | 8/2006 |
| WO | WO 99/07302 | 2/1999 |
| WO | WO 2007/014950 A2 | 2/2007 |

* cited by examiner

*Primary Examiner*—Suhan Ni
(74) *Attorney, Agent, or Firm*—Schiff Hardin LLP

(57) ABSTRACT

A hearing aid device has a custom-fit shell that fits into the helix lock area of the outer ear of a hearing-impaired person, and an RIC tube that is held in the concha of the outer ear and terminates in the ear canal. The combination of the custom-fit shell and the RIC tube in the concha retain the hearing aid in the outer ear.

20 Claims, 1 Drawing Sheet

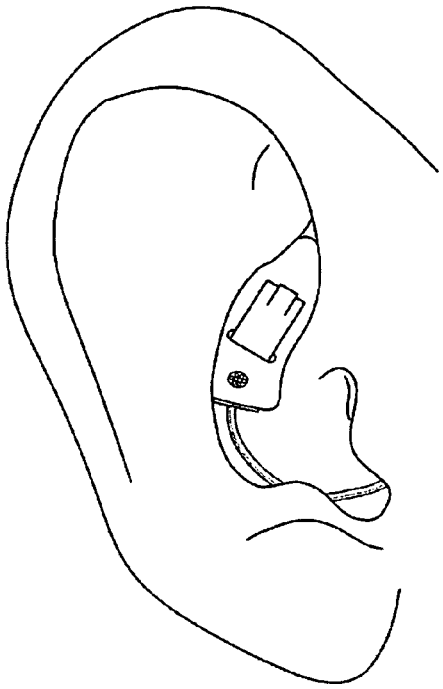
FIG. 1
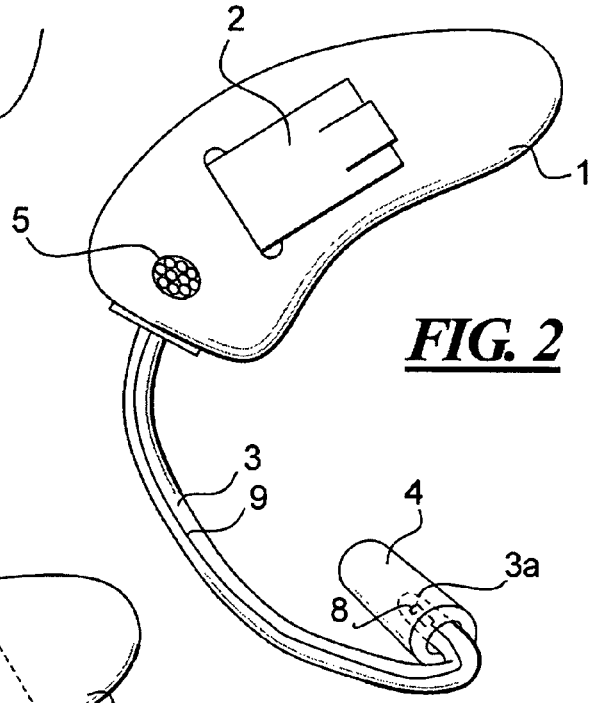
FIG. 2
FIG. 3
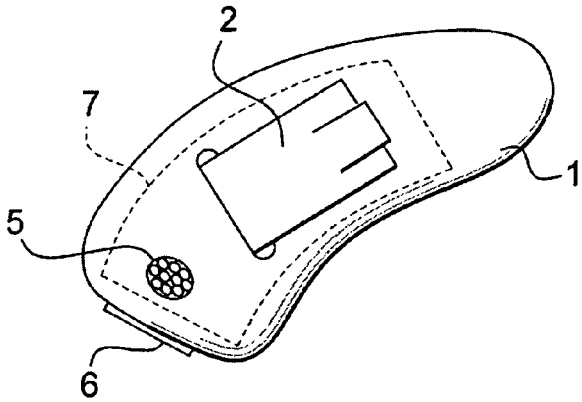
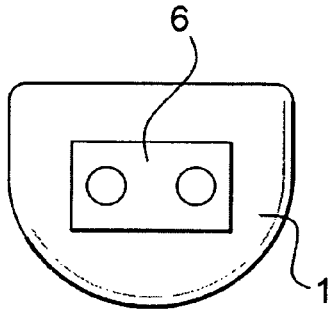
FIG. 4

HEARING AID WITH SOUND TUBE SERVING FOR RETENTION IN CONCHA

BACKGROUND

The present invention is concerned with a hearing aid that makes use of the Receiver-In-Canal (RIC) concept.

A conventional behind the ear (BTE) hearing aid has a small case or housing that fits behind the ear of a hearing-impaired person, and sound is conducted to the middle ear through an ear mold that is generally customized for the wearer of the hearing aid.

Another type of conventional category of hearing aids is the in-the-ear (ITE) hearing aid, which has a housing commonly called an otoplastic, that fits into the concha with a customized fit.

More recently developed hearing aids include in the canal (ITC), mostly in canal (MIC) and completely in the canal (CIC) hearing aids. These hearing aids are quite small, and generally occupy only the bottom half of the external ear (pinna). Generally, ITC hearing aids cannot be seen when directly facing the hearing-impaired person. MIC and CIC hearing aids are even smaller, and often are not visible unless one happens to look directly into the ear of the hearing-impaired person.

A further category of hearing aids that has recently become commercially available is the open-fit or over-the-ear (OTE) hearing aid. These devices have a behind-the-ear housing or case, but it is generally much smaller than a conventional BTE housing. An open fit hearing aid usually has a thin, transparent tube that proceeds into the ear canal. This tube terminates in the ear canal with a small, resilient domed element, that is usually composed of silicone or acrylic material, and holds the tube in place. Sound is conducted into the ear canal via this tube. In a Receiver-In-Canal (RIC) design, this tube is used to carry wires that are attached to the receiver, which sits wholly in the canal.

Open-fit custom hearing aids generally have been difficult to manufacture and have performance difficulties. These designs are particularly susceptible to the "occlusion effect", which is a plugged-up feeling experienced by the wearer in which the wearer hears his own voice as an echo. This is a major reason for hearing aid dissatisfaction and rejection. Furthermore, in known such designs, the actual sound outlet (receiver) sits in the ear canal, resulting in it getting clogged up with ear wax and resulting in hearing instrument failure necessitating repair.

SUMMARY

It is an object of the present invention to provide a hearing aid that makes use of the general RIC concept, but which avoids, or at least reduces, problems that have been associated with conventional devices making use of the RIC concept.

The above object is achieved in accordance with various embodiments of the present invention by a hearing aid that has a customized shell or housing, in which the electronics are contained, that is connected to an RIC tube. The customized shell sits in the helix portion of the outer ear, and the RIC tube is composed of a material that, although somewhat flexible, has a sufficient rigidity to perform a retention function by placing pressure in the outer ear at the back of the concha. Different lengths of the RIC tube can be made available in order to accommodate different ear sizes. The RIC tube is connected to the shell and the electronics therein by a conventional plug, of the type used in a BTE hearing aid making use of the RIC concept. The tube exits the canal aperture at the base of the ear, and is positioned under the antitragus and follows the contour of the concha.

The customized shell has a size designed or selected to enable accurate selection of the correct tube length for the RIC tube in the electronic detailing (e-detailing) and modeling software, using collision detection and part placement. The plug for the tube is mounted in a plate and the recess for the plate is integrated into the custom shell during the e-detailing and modeling process. The face plate can embody a 10A CIC face plate, and thus does not require a unique face plate to be developed. The shell extends into the helix lock area of the ear to ensure secure fitting thereof, and operates in combination with the RIC tube to hold the overall hearing aid arrangement in place. Advantageously, a user-replaceable tip can be provided the directs sound into the ear. Thus, if the tip gets plugged with wax, the wearer can change it himself, thereby avoiding the cost and inconvenience of a factory repair.

DESCRIPTION OF THE DRAWINGS

FIG. 1 shows a hearing aid constructed in accordance with the present invention in place in the ear of a hearing-impaired person;

FIG. 2 is an enlarged illustration of the overall exterior appearance of the inventive hearing aid;

FIG. 3 shows the customized shell by itself, with the electronics board being schematically illustrated therein; and FIG. 4 is an end view of the hearing aid of FIG. 3, showing the face plate for the RIC tube.

DESCRIPTION OF THE PREFERRED EMBODIMENTS

FIG. 1 shows a hearing aid constructed in accordance with the present invention in place in the ear of a hearing-impaired person. The hearing aid includes a housing or shell 1 that is customized to fit the ear, preferably in the helix portion of the outer ear, of the hearing-impaired person, and an RIC tube 3 that proceeds from the shell 1 into the ear canal of the hearing-impaired person. The shell 1 extends into the helix lock area of the ear and the RIC tube 3 proceeds through the concha, with these two components serving to retain the hearing aid in place in the outer ear, particularly during physical exertion. The RIC tube 3 is ideally made of a flexible material allowing the tube to be an integral part of the device by placing pressure in the outer ear at the back of the concha.

As shown in more detail in FIG. 1, the shell 1 has a battery door 2 and a microphone 5 for receiving incoming audio signals that are processed in a suitable manner by circuitry contained within the shell 1. The processed output signal is supplied to the hearing-impaired person via the RIC tube, that terminates in an end 3*a* containing the receiver 8 covered by a domed element 4 (ear mold) that fits snugly in the ear canal. The receiver 8 is electrically connected to the processing circuitry located within the shell via wires 9 that are attached to and run parallel to a longitudinal axis of the RIC tube 3.

Different lengths for the RIC tube 3 can be selected so as to provide the appropriate retention properties for ears of different sizes. The RIC tube 3 exits the canal aperture at the base of the ear and is positioned under the antitragus and then follow the contour of the concha bowl.

As shown in FIGS. 3 and 4, a face plate 6 is disposed at one side of the shell 1 to interface with the RIC tube 3. The face plate 6 can be a standard 10A CIC face plate. The entire RIC tube 3 can be detached by the user and replaced, if necessary, which avoids sending the unit back to the factory for repair. In an alternate embodiment, only the end of the RIC tube 3*a*, is detachable by the user. In either case, the user detachable portion may be implemented by a plug and socket configuration, pins and holes, clips, or any other mechanism that does not involve cutting and soldering.

As schematically illustrated in FIG. 3, the shell 1 contains a circuit board 7 therein (or multiple, connected circuit boards), the components being placed within the shell 1. The components are positioned within the shell 1 using commercially available e-detailing and modeling software, so as to appropriately position the components within the interior of the customized shape of the shell 1. The e-detailing and modeling software embodies collision avoidance, so that when the components are physically mounted, they are all adequately separated from each other, but still fit within the customized shape of the shell 1.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The present invention may be described in terms of functional block components and various processing steps. Such functional blocks may be realized by any number of components configured to perform the specified functions. Furthermore, the present invention could employ any number of conventional techniques for mechanical and electronics configuration and the like.

The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A hearing aid device comprising:

a customized shell having a shape adapted to fit in the helix lock area of an ear of a hearing-impaired person;

processing circuitry mounted within said shell that processes incoming audio signals to produce an audio output dependent on a hearing-impairment of the hearing-impaired person;

a face plate disposed at an exterior of the shell;

a sound-conducting tube having a first end interfacing with said face plate and a second end adapted to terminate in the ear canal of said ear, said sound-conducting tube being adapted to snugly fit into the concha of the ear and, in combination with said shell, exerting a pressure to retain the shell and the sound-conducting tube in said ear; and said sound-conducting tube terminates in the ear canal with a free tube end containing a receiver that is connected to the processing circuitry via wires that run along a length of the sound-conducting tube, the free tube end comprising a domed-element covering said free end and fitting into the ear canal.

2. The hearing aid device as claimed in claim 1 wherein said shell comprises a battery door at a side of said shell that faces outwardly when the shell is disposed in the helix lock area of the ear.

3. The hearing aid device as claimed in claim 1 wherein said shell comprises a microphone at a side of said shell that faces outwardly when the shell is disposed in the helix lock area of the ear.

4. The hearing aid as claimed in claim 1, wherein said sound-conducting tube is user detachable.

5. The hearing aid as claimed in claim 1, wherein said free tube end is user detachable.

6. The hearing aid device as claimed in claim 1, wherein said face plate is a standard 10A CIC face plate.

7. The hearing aid device as claimed in claim 1, wherein said sound-conducting tube is comprised of transparent material.

8. The hearing aid as claimed in claim 1, comprising a circuit board contained in said housing on which various processing circuitry is mounted, said circuit board and said processing circuitry having a shape and position conforming to an interior shape of said shell dependent on said custom-fit.

9. A hearing aid device, comprising:

a shell having a shape adapted to fit in an upper part of a concha of an outer ear of an ear of a hearing-impaired person;

a microphone, a battery, and processing circuitry mounted within said shell, said processing circuitry processing incoming audio signals to produce an audio output dependent on a hearing-impairment of the hearing-impaired person;

an ear piece having a receiver and adapted to fit in an ear canal of the ear of the hearing-impaired person, said shell being larger than said ear piece; and a flexible connecting element having a first end connected to the shell and a second end connected to the ear piece, said connecting element being adapted to snuggly fit into the concha of the outer ear, and said connecting element having a selected length and a selected sufficient rigidity so that in combination with said shell and said ear piece the connecting element performs a retention function by placing pressure at a back of the concha of the outer ear to retain the shell and the ear piece in said ear.

10. The hearing aid device as claimed in claim 9, wherein the connecting element is a flexible tube.

11. The hearing aid as claimed in claim 9, wherein said connecting element is user detachable.

12. The hearing aid as claimed in claim 11 wherein the connecting element comprises a plug and socket interface via which it connects to the shell.

13. The hearing aid as claimed in claim 11 wherein the connecting element comprises a plug and socket interface via which it connects to the ear piece.

14. The hearing aid device as claimed in claim 9 wherein said connecting element is comprised of transparent material.

15. The hearing aid as claimed in claim 9 wherein the shell is a customized shell adapted to an individual shape of the ear.

16. The hearing aid device as claimed in claim 9 wherein said shell comprises a battery door at a side of said shell that faces outwardly when the shell is disposed in the ear.

17. The hearing aid device as claimed in claim 9 wherein said shell comprises said microphone at a side of said shell that faces outwardly when the shell is disposed in the ear.

18. The hearing aid as claimed in claim 9 wherein the ear piece is a customized ear mold.

19. The hearing aid as claimed in claim 9 comprising a circuit board contained in said shell on which said processing circuitry is mounted, said circuit board having a shape and position conforming to an interior shape of said shell.

20. The hearing aid as claimed in claim 9 wherein said connecting element has a wire therein for connecting said receiver to said processing circuitry.

* * * * *